United States Patent [19]

Külker

[11] 4,284,233

[45] Aug. 18, 1981

[54] SELF-DUMPING CENTRIFUGAL SEPARATOR DRUM

[75] Inventor: Otto Külker, Delde, Fed. Rep. of Germany

[73] Assignee: Westfalia Separator AG, Oelde Westfalen, Fed. Rep. of Germany

[21] Appl. No.: 83,880

[22] Filed: Oct. 11, 1979

[30] Foreign Application Priority Data

Oct. 14, 1978 [DE] Fed. Rep. of Germany ..... 2844917

[51] Int. Cl.[3] ..... B04B 11/00

[52] U.S. Cl. ..... 233/20 A; 233/47 R

[58] Field of Search ..... 233/20 A, 20 R, 46, 233/47 R, 47 A, 27, 28, 38, 19 R, 19 A, 16

[56] References Cited

U.S. PATENT DOCUMENTS

| | | | |
|---|---|---|---|
| 3,754,701 | 8/1973 | Bruning | 233/20 A |
| 4,027,820 | 6/1977 | Kulker | 233/20 A |
| 4,069,969 | 1/1978 | Tanaka | 233/20 A |
| 4,143,806 | 3/1979 | Moriguchi | 233/20 A |
| 4,151,951 | 5/1979 | Kohlstette | 233/20 A |

*Primary Examiner*—Robert W. Jenkins

*Attorney, Agent, or Firm*—Sprung, Felfe, Horn, Lynch & Kramer

[57] ABSTRACT

Centrifugal separator having a piston valve 3 for opening and closing of apertures adjacent the periphery of the drum for discharge of solids through passageway 19. The drum is provided with a ring 16 which in part defines the passageway, and which has a lip 15. The piston valve has a lip 13. When the piston valve 3 moves down, the apertures are open, and after a short interval the lip 13 strikes the lip 15 closing the passageway 19. Thereby discharge of solids is stopped. Thus, the piston valve need move in only one direction, up or down, for a discontinuous discharge of solids. That provides better control, since for a discharge, the piston need be accelerated in only one direction.

6 Claims, 3 Drawing Figures

SELF-DUMPING CENTRIFUGAL SEPARATOR DRUM

BACKGROUND

Figure 1:
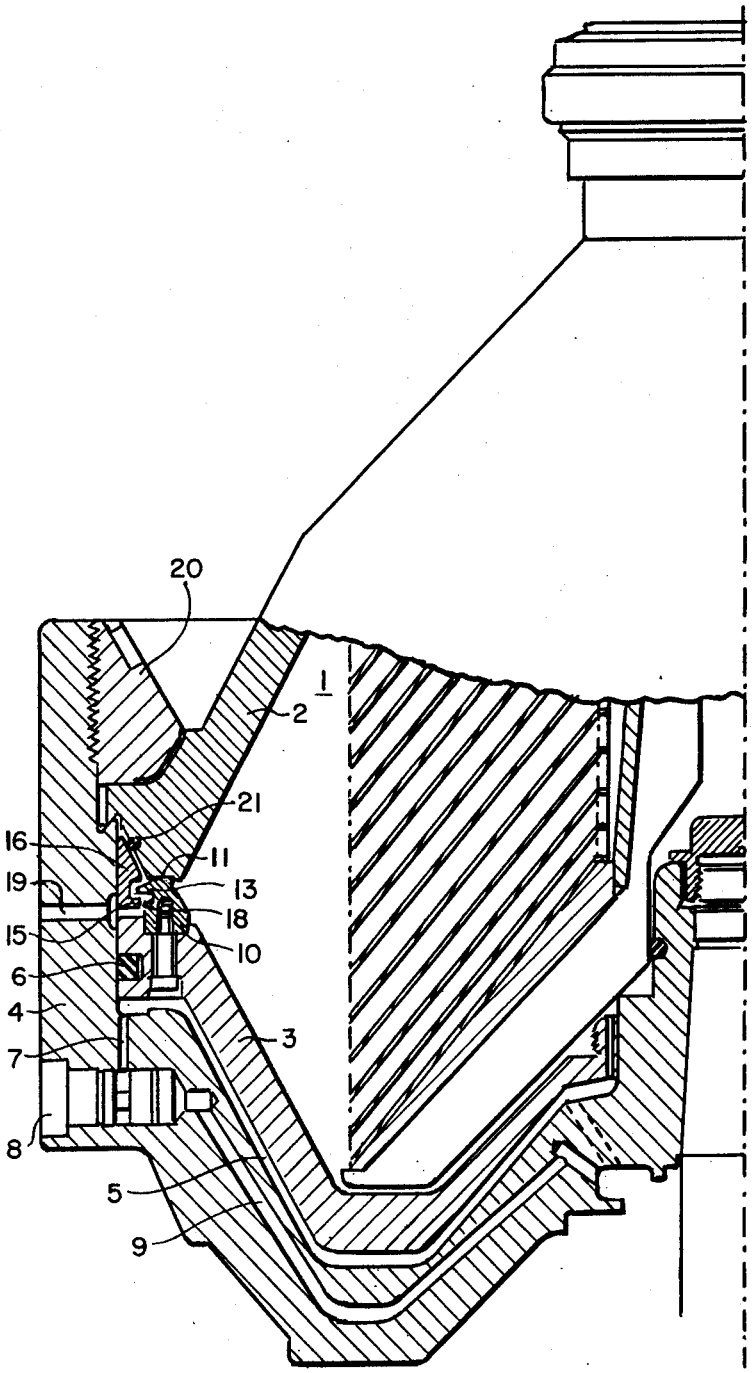

The invention relates to a self-dumping centrifugal separator drum having a piston valve defining one end of the separating and solids chamber for the control of the ejection apertures in the drum periphery, permitting the performance of dumping operations selectively and in a time-independent manner, the closing chamber being supplied with control fluid in a known manner, and fluid-operated valves being installed in the control fluid outlet passages.

A centrifugal drum separator of such construction is known, for example, from German Pat. No. 2,041,371 (U.S. Pat. No. 3,754,701) and serves for the clarification or separation of liquids containing solids, the closing chamber filled with control fluid having a larger radial expanse than the inner chamber of the drum, so that, when the chamber is completely filled, the closing pressure acting from this side on the piston valve is always greater than the pressure of the drum charge acting in the opening sense from the other side. For the purpose of solids ejection, control fluid is let out of the closing chamber through fluid-controlled valves with the drum at full rotatory speed, and the closing pressure is thus relieved. Under the pressure of the drum charge the piston valve then moves into the open position, opening the ejection apertures. Depending on the nature and consistency of the solids which are to be separated, so-called partial dumping can then be performed at shorter intervals of time or full dumping can be performed at greater intervals. In the performance of partial dumping, the drum is opened only slightly and briefly by letting only so much control fluid out of the closing chamber through valves that only a portion of the solids collected in the solids chamber is ejected, while the remainder of the solids stays in the drum as a safety ring. This prevents an excessively great amount of liquid from being thrown out of the drum with the solids and being wasted.

These discharge systems, however, run into difficulty in the removal of solids which are caked on the inner wall of the drum. When full dumping is performed, there is the danger that the solids will not be full discharged, so that imbalance damage might occur, and when partial dumping is performed, the discahrge gap is so small that most of the solids remain stuck in the drum and only liquid emerges. Even very rapidly operating control-water systems which open a very large gap for only a very brief time for the partial dumping operation have limitations due to the inertia of the system. Such a control system is known, for example, from German Offenlegungsschrift No. 2,704,903 (U.S. Pat. No. 4,151,951).

THE INVENTION

It is the object of the present invention to create a better and simpler control system in self-dumping centrifugal separator drums of the above-described type.

The possibility of achieving a still greater opening gap in still less time, especially during partial dumping, is offered by an alternately sealing piston valve which closes off a gap for the solids both at the uppermost end of its stroke and at the lowermost end of its stroke, and removes solids at each stroke. This brings it about that the piston valve does not move forward and back again for each opening and closing action, i.e., it does not have to be accelerated twice, but rather only once each time for the purpose of opening and closing the gap. As a consequence, the piston valve can be operated considerably faster and thus the gap can be considerably wider than it can in the former unilaterally sealing piston valve system. To this is added a further doubling of the gap size in that by the use of two discharge gaps in series and alternating them with regard to the opening and closing action, no more than half of the gap width is available for the passage of the solids. But the absolute width of the gap at the first seal point, which is virtually the span of the bridging solid, is what determines the breaking out of the tightly caked solid.

All in all, the alternately sealing piston valve system results in a multiplication of the gap width, assuming that the same amount of solids is to be ejected and the same control-water system is used.

The multiplication of the gap width achieved in this manner gives promise of a substantial improvement of the partial dumping of tightly caked solids.

Although with this system only partial dumping is possible, this dumping is of such intensity that in its mechanical cleaning effect it is equal to a full dumping.

The object of the invention is achieved by providing in the separating chamber an alternately sealing piston valve to whose outer end face there is affixed a replaceable closing ring provided with an outer lip which in the upper end position acts sealingly against a sealing surface disposed in the drum cover and in the lower end position acts sealingly against a sealing surface provided with a blocking ring having an internal lip and disposed in the drum periphery, which in the course of each stroke opens the discharge gap for the discharge of solids between piston valve and drum cover leading from the separating chamber, and a discharge gap between the piston valve and the blocking ring provided in the drum periphery.

The construction in accordance with the invention brings it about that, for each discharge operation only one stroke is now needed, the aperture cross section is of the same size at each stroke, and only the time of opening of the enlarged aperture cross section has to be controlled by means of a control fluid. Both smaller and larger partial dumping can be performed, the larger dumping being able to be equivalent to full dumping.

The aperture for the discharge of solids between the piston valve and the blocking ring disposed in the drum periphery can be an annular gap or can consist of one or more outlet openings provided in the inner lip of the blocking ring.

In one special embodiment, one or more nozzle-like apertures are provided in the closing ring at the periphery of the piston valve, which make it possible during operation to continuously remove a small amount of solids.

Thus, the invention is directed to a centrifugal separator comprising a drum for the separation of a liquid mass into a heavier fraction and a lighter fraction and collection of the heavier fraction adjacent the drum periphery, ejection aperture means at the drum periphery for ejection heavier fraction, and valve means for opening the aperture means for discharge of heavier fraction from the drum by movement of a valve member from a first position to a second position, and for closing of the aperture means by movement of the valve member from the second position to the first position.

Further, a passageway for receiving heavier fraction from the valve means and the discharge thereof from the drum, is provided. According to the invention, means are provided for closing said passageway upon arrival of the valve member at said second position. Thereby, upon movement of the valve member from the first position to the second position, the aperture means is open, heavier fraction is discharged from the drum, and said passageway is closed so that the discharge of heavier fraction is stopped, and upon movement of the valve member from the second position to the first position the passageway is opened, heavier fraction is discharged from the drum, and said aperture means is closed so that discharge of heavier fraction is stopped.

The valve means can be a piston valve which defines at least part of one of the upper and lower sides of the drum, and the separator can further comprise means defining a control chamber on the axially outwardly disposed side of the piston valve for receiving and discharging control fluid for movement of the piston valve between said positions. The piston valve can comprise a replaceable closure ring for engagement with a surface on the other of the upper and lower sides of the drum, for said first position, while the ring has a radially outwardly disposed lip, and means are provided in said passageway for engagement with said lip for the closing of the passageway for said second position. Also, the closure ring can have at least one bore for discharge of heavier fraction when the piston valve is in the first position and when the piston valve is in the second position.

Figure 2:
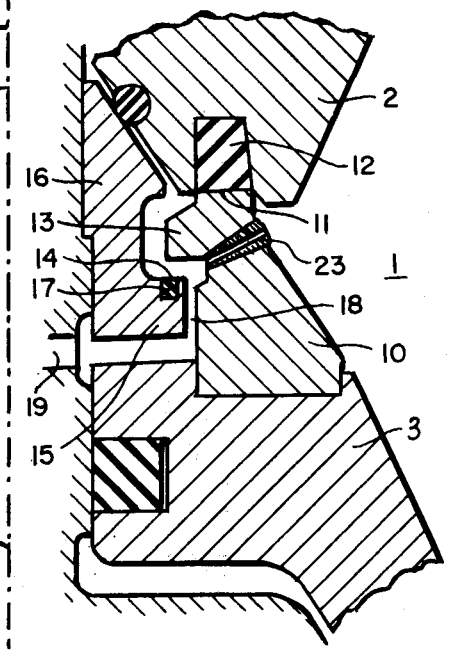

An example of the embodiment of the invention is set forth in the drawing, wherein FIG. 1 is a longitudinal cross section of the left half of a centrifugal separator drum constructed in accordance with the invention, FIG. 2 is an enlarged detail of the discharge system of FIG. 1 which has an annular gap between the closing ring and the blocking ring, and showing the piston valve in the the upper end position.

Figure 3:
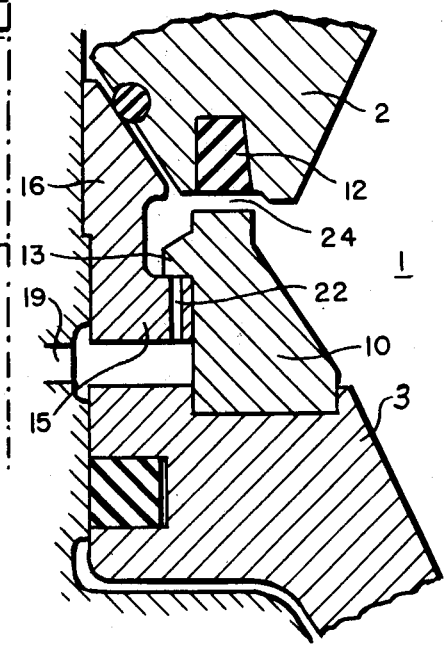

FIG. 3 is a detail of an alternative discharge system and which has outlet apertures in the blocking ring, showing the piston valve in the lower end position.

In FIG. 1, the numeral 1 designates the separating chamber of the centrifugal separator drum, which is defined at the upper end by the drum cover 2 and at the lower end by the piston valve 3. Between the piston valve, which is disposed for sliding axially, and the adjoining drum periphery 4 is situated the closing chamber 5 which is sealed at its periphery by the sealing ring 6.

Outlet passages 7 in the drum periphery extend from the radially outer end of the closing chamber, and can be opened and closed by valves 8. The operation of the valves is performed also by means of a control fluid which is fed through passages 9. The sealingly guided piston valve 3 is provided on its upper face with a replaceable and fixedly joined closure ring 10 which, when the piston valve is in its upper end position, seals the separating chamber against a sealing surface 11 disposed on the drum cover or advantageously against a sealing ring 12 (FIG. 2).

The closure ring 10 is provided with an outer lip 13 which, when the piston valve is in its bottom end position, seals against the sealing surface 14 (FIG. 2) of a blocking ring 16 which is provided with an inner lip 15 and is fixedly and removably disposed in the drum periphery. Advantageously, a sealing ring 17 (FIG. 2) is provided on the inner lip 15.

Between the closure ring 10 and the inner lip 15 of the blocking ring 16 there is provided an annular gap 18, and outlet apertures 19 are provided in the drum periphery.

The drum periphery 4 and the drum cover 2 are held together by a lock ring 20 and the drum cover is sealed against the blocking ring 16 by means of a sealing ring 21.

The centrifugal separator drum operates as follows: As soon as the separating chamber 1 has filled up with solids or with concentrate to the extent that a dumping must be performed, a portion or all of the control fluid is taken out of the closing chamber 5 through valve 8, whereupon the piston valve moves axially toward the lower end position as a result of the drum charge present in the separating chamber. During this piston stroke, a gap 24 (FIG. 3) is opened between the closure ring 10 on the piston valve 3 and the sealing surface 11 or sealing ring 12 on the drum cover 2, so that a portion of the drum charge can escape through the gap and the annular gap 18 in series therewith. As soon as the piston valve has reached its lower end position, however, the outer lip 13 engages the inner lip 15 with sealing ring 17, thus sealing off the discharge gap 18 so that the discharge of solids is interrupted.

When the feeding of control fluid into the closing chamber 5 moves the piston valve axially toward the upper end position, the gap 18 is again opened, and solids are discharged until the piston valve has reached the upper end position.

The amount of solids or concentrate removed in each case is determined by the faster or slower discharge or delivery of control fluid.

In FIG. 2, sealing rings 12 and 17 are disposed in the drum cover 2 and in the inner lip 15 of blocking ring 16, and nozzle-like apertures 23 are provided in the closure ring 10 and permit a continuous discharge of a portion of the solids or concentrate from the separating chamber 1 when the piston valve 3 is in its upper end position and lower end position.

In FIG. 3, instead of the discharge gap 18 (FIG. 1), discharge bores 22 are provided in the inner lip 15 of the blocking ring 16, which when the piston valve 3 is in the lower end position are covered by the outer lip 13 of the closure ring, the discharge gap 24 remaining open to the separating chamber 1.

What is claimed is:

1. In a centrifugal separator comprising a drum for the separation of a liquid mass into a heavier fraction and a lighter fraction and collection of the heavier fraction adjacent the drum periphery, ejection aperture means at the drum periphery for ejection of heavier fraction, valve means for opening the aperture means for discharge of heavier fraction from the drum by movement of a valve member from a first position to a second position, and for closing of the aperture means by movement of the valve member from the second position to the first position, a passageway for receiving heavier fraction from the valve means, the improvement which comprises means for closing said passageway upon arrival of the valve member at said second position, whereby upon movement of the valve member from the first position to the second position, the aperture means is opened, heavier fraction is discharged from the drum and said passageway is closed so that the discharge of heavier fraction is stopped, and upon movement from the second position to the first position the passageway is opened, heavier fraction is discharged from the drum, and said aperture means is closed so that the discharge of heavier fraction is stopped.

2. Separator of claim 1, wherein said valve means is a piston valve defining at least part of one of the upper and lower sides of the drum, the separator further comprising means defining a control chamber on the axially outwardly disposed side of the piston valve for receiving and discharging control liquid for movement of the piston valve between said positions.

3. Separator of claim 2, the piston valve having a replaceable closure ring for engagement with a surface on the other of the upper and lower sides of the drum, for said first position, the ring having a radially outwardly disposed lip, means in said passageway for engagement with said lip for said closing of the passageway, for said second position.

4. Separator of claim 3, a sealing ring on the drum for being abutted by the closure ring upon said engagement involving the closure ring, and a sealing ring on the drum for being abutted by said lip for said closing of the passageway.

5. Separator of claim 4, said passageway being defined in part by a blocking ring disposed outwardly of the closure ring, said blocking ring comprising an internal lip, the lip having apertures which form a part of the passageway.

6. Separator of claim 3, the closure ring having at least one bore for discharge of heavier fraction when the piston valve is in the first position and the second position.

* * * * *